US011737637B1

(12) United States Patent
Ebrahimi Afrouzi

(10) Patent No.: US 11,737,637 B1
(45) **Date of Patent: *Aug. 29, 2023**

(54) ROBOTIC FLOOR CLEANING DEVICE WITH MOTOR FOR CONTROLLED LIQUID RELEASE

(71) Applicant: Ali Ebrahimi Afrouzi, Henderson, NV (US)

(72) Inventor: Ali Ebrahimi Afrouzi, Henderson, NV (US)

(73) Assignee: AI Incorporated, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/891,235

(22) Filed: Aug. 19, 2022

Related U.S. Application Data

(63) Continuation of application No. 17/160,859, filed on Jan. 28, 2021, now Pat. No. 11,452,426, which is a continuation of application No. 16/058,026, filed on Aug. 8, 2018, now Pat. No. 10,932,640.

(51) Int. Cl.
*A47L 11/40* (2006.01)
*A47L 13/20* (2006.01)
*A47L 13/58* (2006.01)

(52) U.S. Cl.
CPC ..... *A47L 11/4088* (2013.01); *A47L 11/4083* (2013.01); *A47L 13/20* (2013.01); *A47L 13/58* (2013.01); *A47L 2201/06* (2013.01)

(58) Field of Classification Search
CPC ... A47L 13/20; A47L 11/4088; A47L 11/4083
See application file for complete search history.

(56) References Cited

U.S. PATENT DOCUMENTS 2,535,244 A * 12/1950 Voorhis ..... A47L 13/59 100/271
8,336,160 B2 * 12/2012 Chen ..... A47L 13/58 15/264
8,407,849 B2 * 4/2013 Chen ..... A47L 13/58 15/260
8,689,388 B1 * 4/2014 Morad ..... A47L 13/257 15/119.2
2007/0016328 A1 * 1/2007 Ziegler ..... A47L 9/009 701/23
2011/0277259 A1 * 11/2011 Chen ..... A47L 13/20 15/228
2012/0241389 A1 * 9/2012 Van Landingham, Jr. ..... A47L 13/51 15/260
2019/0274515 A1 * 9/2019 Fernandez ..... A47L 13/52

* cited by examiner

*Primary Examiner* — Michael D Jennings

(57) ABSTRACT

A mop module of a robot, including: a liquid reservoir for storing liquid; and an electronically-controlled liquid release mechanism; wherein: the electronically-controlled liquid release mechanism releases liquid from the liquid reservoir onto a work surface of the robot for mopping; a schedule for mopping at least one area is determined by a processor of the robot or based on user input provided to an application of a communication device paired with the robot; and a quantity of liquid released while the robot mops the at least one area is determined by the processor of the robot or based on user input provided to the application of the communication device paired with the robot.

20 Claims, 4 Drawing Sheets

ROBOTIC FLOOR CLEANING DEVICE WITH MOTOR FOR CONTROLLED LIQUID RELEASE

CROSS-REFERENCE TO RELATED APPLICATIONS

This application is a Continuation of U.S. Non-Provisional application Ser. No. 17/160,859, filed Jan. 28, 2021, which is a Continuation of U.S. Non-Provisional application Ser. No. 16/058,026, filed Aug. 8, 2018, each of which is hereby incorporated herein by reference.

FIELD OF THE DISCLOSURE

The disclosure relates to robotic devices that clean surfaces, and more particularly, a controlled liquid releasing mechanism.

BACKGROUND

The mopping feature of mobile robotic floor cleaning devices is well known in the art. However, issues such as the leakage of mopping liquid when the robot is not in movement have remained. In prior art, the mopping liquid is free to flow without any control. Without a controlled liquid release mechanism, the mopping liquid is inefficiently consumed resulting in the accumulation of mopping liquid, thereby risking damage to the robotic device and causing unwanted leakage of the mopping liquid onto a working surface. In other art, the liquid is controllably dispensed onto the flooring surface through a nozzle or by releasing a valve by controller means. When the mopping feature is used via a controller the robotic device requires additional equipment to deliver the dispensing instruction to the nozzle thereby requiring additional maintenance and increasing cost. A mechanism is required for providing the controlled release of mopping liquid that is more efficient than those presently used.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Some aspects provide a mop module of a robot, including: a liquid reservoir for storing liquid; and an electronically-controlled liquid release mechanism; wherein: the electronically-controlled liquid release mechanism releases liquid from the liquid reservoir onto a work surface of the robot for mopping; a schedule for mopping at least one area is determined by a processor of the robot or based on user input provided to an application of a communication device paired with the robot; and a quantity of liquid released while the robot mops the at least one area is determined by the processor of the robot or based on user input provided to the application of the communication device paired with the robot.

Some aspects provide a robot including the above-described mop module.

BRIEF DESCRIPTION OF THE DRAWINGS

Non-limiting and non-exhaustive features of the present invention are described and depicted with reference to the following figures, wherein like reference numerals refer to like parts throughout the various figures.

DETAILED DESCRIPTION OF SOME EMBODIMENTS

Figure 1:
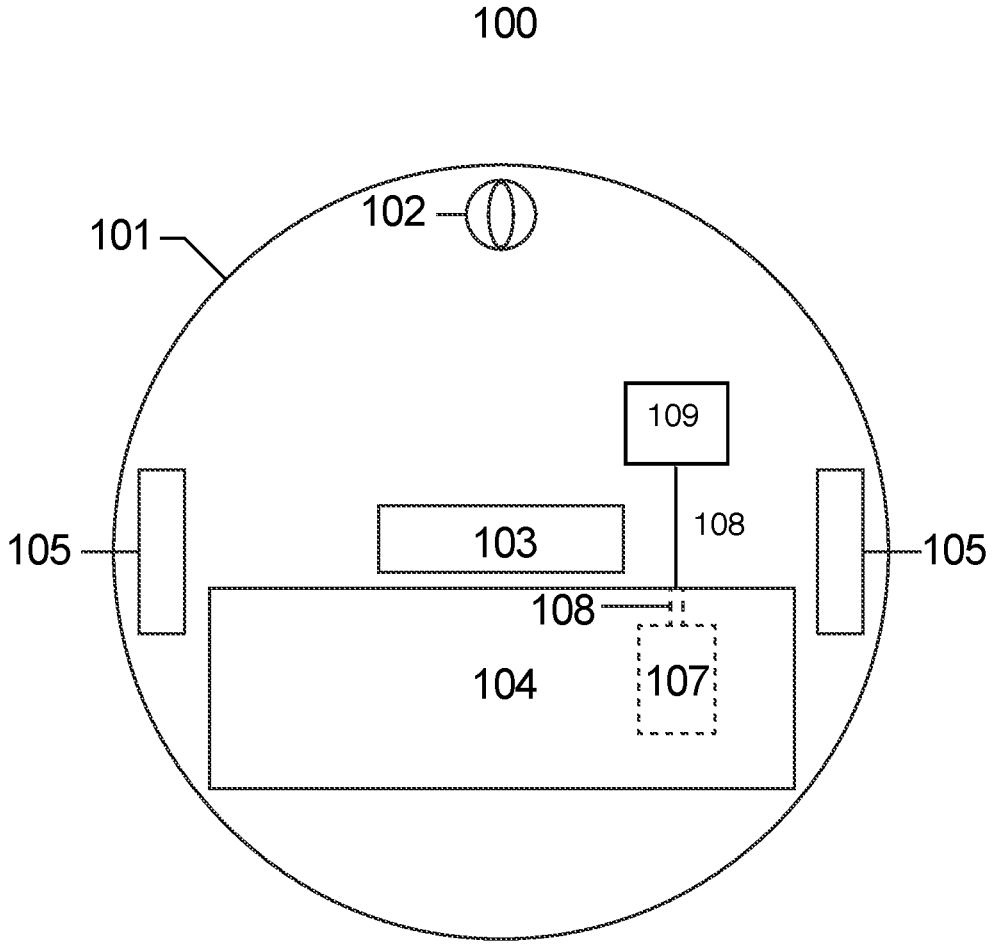
FIG. 1 illustrates a bottom view of a robotic device, according to some embodiments.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Some embodiments introduce a method for a mobile robotic floor cleaning device to have a controlled liquid releasing mechanism for mopping purposes.

Some embodiments introduce a motorized mechanism which controls the release of liquid for mopping purposes.

Some embodiments introduce a method for a mobile robotic floor cleaning device to use a controlled liquid releasing mechanism for mopping purposes and avoid the release of liquid except under predetermined circumstances.

Some embodiments introduce a method by which liquid is released by the operation of a separate motor designed to operate the controlled release of liquid. By controlling the release of liquid through the operation of this motor the release of liquid is stopped when the motor ceases to operate.

As understood herein, the term "robotic floor cleaning device" may be defined generally to include one or more autonomous or semi-autonomous devices having mobility, processing, and/or cleaning elements. For example, a robot or robotic floor cleaning device may comprise a casing or shell, a chassis including a set of wheels, a motor to drive wheels, a cleaning apparatus, a processor and/or controller that processes and/or controls motors and other robotic autonomous or cleaning operations, power management, etc., and one or more clock or synchronizing devices.

Generally, embodiments relate to robotic devices that clean surfaces, and more particularly, a controlled liquid releasing mechanism.

Some embodiments propose a robotic floor cleaning device that features a mechanism for controlling the release of liquid for mopping purposes. A mobile robotic cleaning device may include a liquid reservoir container for holding cleaning liquids. A rotatable cylinder with at least one aperture for storing a limited quantity of liquid may be connected to a motor by a member. The cylinder may be connected to the motor such that cylinder rotation is controlled by the motor. The cylinder may be within or adjacent to a liquid reservoir tank. There may be a passage below the cylinder and between the cylinder and a drainage mechanism. Each time at least one aperture is exposed to the liquid within the reservoir tank, it fills with liquid. As the motor operates, the connected cylinder is rotated until the aperture is adjacent to the passage. Upon exposure to the passage, the liquid will flow out of the aperture by means of gravity, pass through the passage, and enter the drainage mechanism, whereby the liquid may be delivered onto the working surface.

In some embodiments, a processor of the robotic device may control operation of the motor based on information received from, for example, an odometer or gyroscope providing information on movement of the robotic device, optical encoder providing information on rotation of the wheels of the robotic device or its distance travelled, user interface, floor sensors, timer, sensors for detecting fluid levels or other types of device that may provide information that may be useful in controlling the operation of the motor and hence the release of cleaning fluid. For example, in some embodiments, the motor may operate based on movement of the mobile robotic device. For instance, if the mobile robotic device is static, the motor will not operate, in which case liquid will not vacate the liquid reservoir. In other embodiments, the motor may become operational at predetermined intervals wherein intervals may be time based or based on the distance travelled by the robotic device or based on any other metric. In some embodiments, the motor may become operational upon the detection of a particular floor type, such as hardwood or tiled flooring. In some embodiments, the motor may become operational upon the detection of a mess on the floor. In some embodiments, the motor may operate based on whether or not the wheels of the mobile robotic device are spinning. In some embodiments, a user of the mobile robotic cleaning device may control the operation of the motor and hence the release of cleaning fluid by, for example, pushing a button on the robotic device or remote control. In some embodiments, the motor controlling the cylinder and hence the release of cleaning fluid may automatically cease operation upon detecting the depletion of the cleaning fluid.

In some embodiments, the motor may operate at varying levels of power thereby controlling the speed of the cylinder and release of fluid. For example, if the motor is operating at a high level of power, liquid is released more frequently. Therefore, if the speed of the mobile robotic device is maintained yet the power of the motor is increased, more liquid will be dispersed onto the work area. If the motor is operating at a lower level of power, liquid is released less frequently. Therefore, if the speed of the mobile robotic device is maintained yet the power of the motor is decreased, less liquid will be dispersed onto the work area. In some embodiments, the processor of the mobile robotic device may control the level of power of the motor. In some embodiments, the level of power of the motor may be automatically adjusted by the processor based on the speed of the mobile robotic cleaning device, the type of floor, the level of cleanliness of the work area, and the like. In some embodiments, the level of power of the motor may be increased and decreased during operation by the processor of the robotic device. In some embodiments, the user of the mobile robotic cleaning device may increase or decrease the power of the motor and hence the amount of cleaning fluid released by, for example, a button on the robotic device or a remote control.

In some embodiments, operation of the motor may be dictated by the floor type of the work surface. Floor sensors of the mobile robotic cleaning device may continually send signals to the processor of the robotic device indicating the floor type of the work surface. For example, if the floor sensors detect a carpeted work surface then the processor may cease operation of the motor, in which case liquid will not be released onto the carpeted surface. However, if the floor sensors detect a hard floor surface, such as a tiled surface, the processor may actuate the motor thereby rotating the cylinder and releasing cleaning liquid onto the floor. In some embodiments, the sensors may be able to differentiate between different hard floor surface types and direct actions accordingly. For example, mopping on a hardwood floor surface may damage the hardwood floor. If during a mopping sequence the floor sensors detect that the floor has transitioned from a tiled surface to a hardwood surface rather, the robotic device may cease operation of the mopping mechanism.

In other embodiments, sensors of the mobile robotic cleaning device may be used for the detection of spills, dirt, or other similar like material to be mopped off of a floor. If during normal operation a mess, such as a spill, dirt, or the like is detected by the sensor of the robotic device, the processor of the robotic device may actuate the motor thereby releasing liquid for cleaning.

In some embodiments, a user may set a schedule for the controlled release of cleaning liquid onto the working surface using, for example, a communication device application paired with the mobile robotic cleaning device. The communication device may be an electronic mobile device, a smart phone, a laptop, a tablet, a remote, a user interface on the mobile robotic device or other types of communication devices with graphical user interface. The communication device application may be a mobile application that is downloaded, a web application, a software, or the like. In some embodiments, the user may select that the mobile robotic device operate at particular times thereby releasing the liquid at particular times. In some embodiments, the user may schedule particular times for the release of fluid. In other embodiments, the user may select that the liquid be released at particular locations. For example, a user may select that mopping and hence the release of fluid be executed in the kitchen but not in the living room. Additionally, the user may select that the liquid be released in certain rooms at particular times while in others the liquid be released at a later time. The user may also be able to select the order of rooms to be cleaned. For example, the user may select that the kitchen be cleaned with cleaning fluid prior to cleaning the dining area. In some embodiments, the user may also set the level of fluid to be released during cleaning. For example, the user may choose to have high levels of fluid released in a particular area or on certain cleaning days and reduced levels of fluid released in another area of cleaning day, the level of fluid released being controlled by the speed of the motor and hence the attached cylinder.

In some embodiments, the robotic cleaning device may use sensors to detect if mopping will create a dangerous environment for users. For example, if an obstacle sensor detects that a user is in a designated room that is to be cleaned, the device may not release liquid as it may cause a hazard of slipping and falling by the user. In some embodiments, the robotic cleaning device may delay cleaning until the area is clear of users.

In some embodiments, the robotic cleaning device may alert the user when liquid has been released into an environment to reduce the risk of slipping and falling by, for example, a communication device application, a sound or a display on a user interface of the robotic device. Additionally, in some embodiments, the robotic cleaning device may alert the user that it is going to clean a room and/or that it is in the process of cleaning a room. In some embodiments, the user may have to provide input to acknowledge warnings prior to the mobile robotic cleaning device beginning the cleaning process.

In some embodiments, the mobile robotic device may monitor how much cleaning fluid was released for a given room and the amount of fluid necessary in cleaning a given room may be monitored and the data collected and stored. In some embodiments, the data may be used for optimization of future cleaning cycles. For example, if a given room is large and requires the use of a large amount of liquid the mobile robotic cleaner may clean this room and go back to a docking station to receive more liquid or alert the user that more liquid is necessary prior to cleaning a second room.

In some embodiments, the processor of the mobile robotic cleaning device may utilize machine learning methods to learn the user's preferences. In embodiments, every time a user sets a cycle, the processor may store the information for future use. For example, if a particular cycle is used repeatedly without interruption, the processor may assume that the cycle is a preferable cleaning cycle of the user. In some embodiments, the processor of the mobile robotic cleaning device may observe the time, location, cleaning parameters such as speed or amount of fluid released, type of cleaning, cleaning duration and the like for each cleaning cycle and store this data for optimization of future cleaning cycles. In some embodiments, the level of power used by the motor during each cleaning cycle and for each room may be collected and stored. If a user interrupted a cycle, this data may also be stored for future use. If a user was detected the data pertaining to the time and location that this occurred may be stored for future use. Using all the data collected, the processor of the mobile robotic device may attempt to create a cleaning cycle that is preferable to the user or that is most efficient. In some embodiments, efficiency may be measured based on total cleaning time, repeat coverage, etc. With every cleaning cycle, the collected data may be accumulated and combined to give the user the best experience possible and/or provide the most efficient cleaning cycle.

A "drainage mechanism," as understood herein, may be defined generally to include a mechanism for dispersing liquid throughout a plane. For example, a drainage mechanism may include a hollow body with a perforated underside through which liquid may pass to surfaces below.

FIG. 1 illustrates a bottom view of a robotic floor cleaning device 100. Robotic floor cleaning device 100 is comprised of chassis 101, non-propelling wheel 102, mobile robotic device's motor 103, mop module 104, and propelling wheels 106. Rotatable cylinder 107 is positioned inside mop module 104 and is connected to wet mop motor 109 by connecting member 108 that transfers rotational movement to the cylinder 107. This connecting member may be comprised of an axle and/or gear mechanism.

Figure 2A:
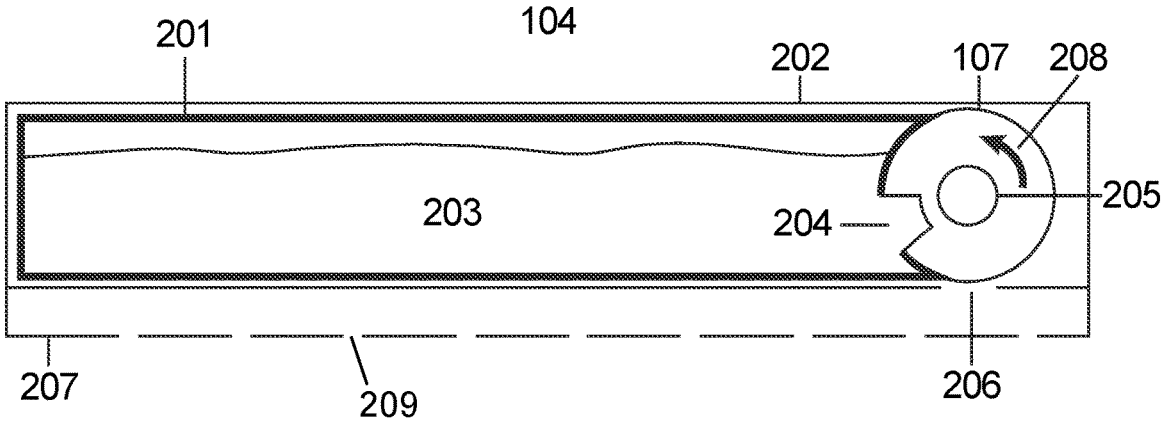
FIG. 2A illustrates a cross-sectional view of a mop attachment module, according to some embodiments, whereby a rotational cylinder is blocking liquid from escaping a reservoir.

FIG. 2A illustrates a cross-sectional view of the mop module 104. In this embodiment, the rotatable cylinder 107 is positioned adjacent to the liquid reservoir 201, however, other arrangements are possible. Mop module 104 is comprised of frame 202, liquid reservoir 201 containing liquid 203, rotatable cylinder 107 (which includes aperture 204 and axle 205), passage 206, and drainage mechanism 207. In this position, liquid 203 fills aperture 204 and rotatable cylinder 107 is blocking liquid from escaping reservoir 201.

As axle 205 turns, cylinder 107 will be rotated in direction 208 and aperture 204 will be rotated toward passage 206.

Figure 2B:
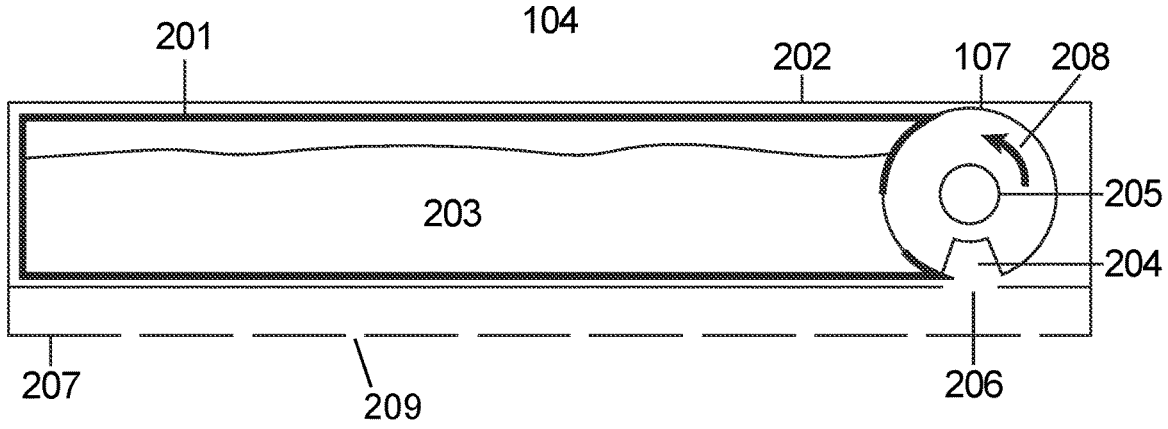
FIG. 2B illustrates a cross-section of a mop attachment module, according to some embodiments, whereby a rotational cylinder is positioned adjacent to a passage allowing liquid to flow from a reservoir.

FIG. 2B illustrates a cross-sectional view of mop module 104 after cylinder 107 has been rotated in direction 208. In this position, cylinder 107 is rotated so that aperture 204 is adjacent to passage 206. In this position, liquid that had entered aperture 204 while it was previously adjacent to liquid 203 will flow downwards through passage 206 by means of gravity into drainage mechanism 207, to be dispersed onto the working surface through openings 209.

Liquid 203 is only delivered to drainage mechanism 207 when cylinder 107 is rotating. Since rotation of cylinder 107 is controlled by rotation of axle 205, liquid is no longer delivered to drainage mechanism 207 when axle 205 stops rotating.

The arrangement of components may vary from the example illustrated without departing from the scope of the invention.

Figure 3A:
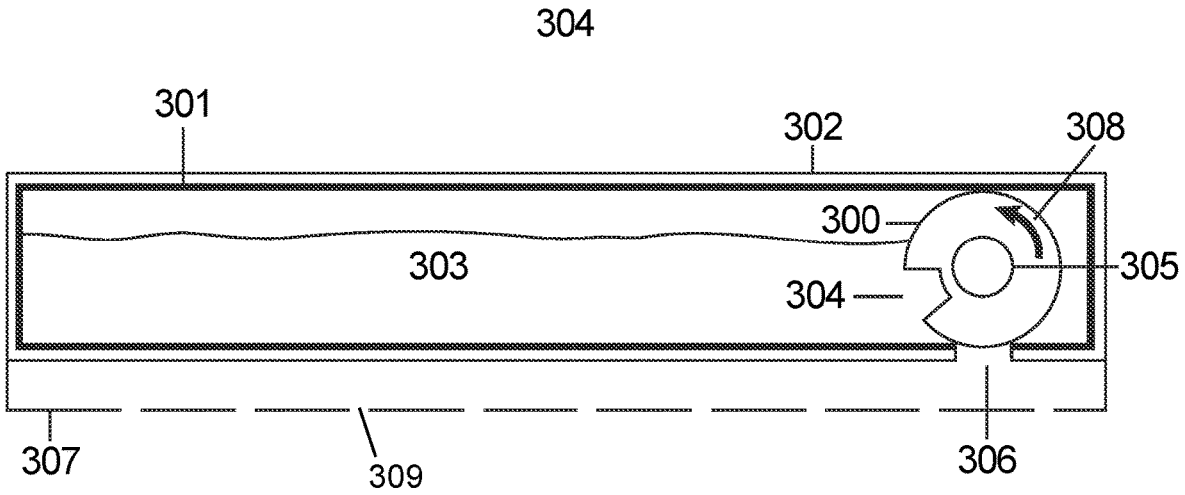
FIG. 3A illustrates a cross-section of a mop attachment module, according to some embodiments, whereby a rotational cylinder is blocking liquid from escaping a reservoir.
Figure 3B:
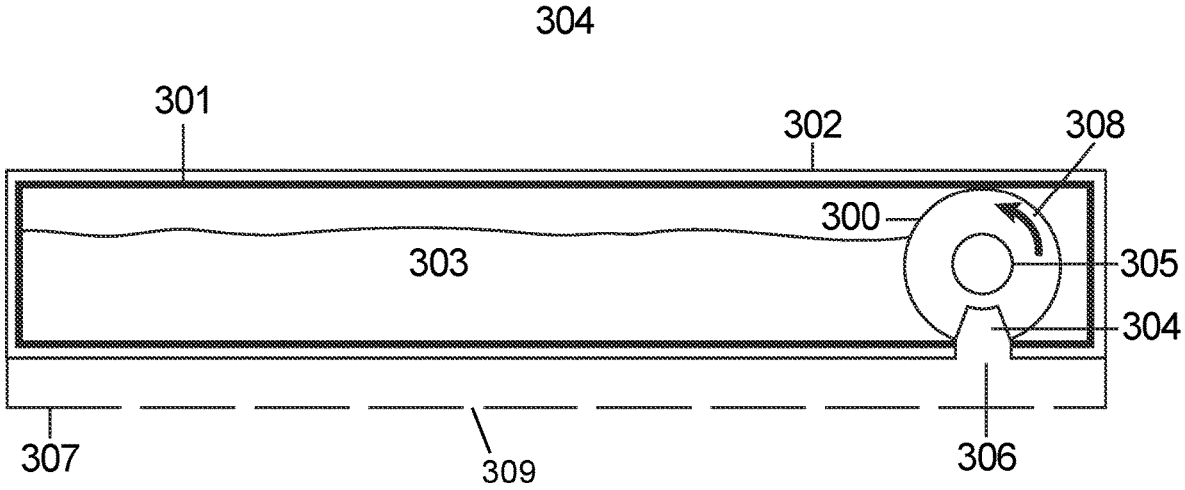
FIG. 3B illustrates a cross-section of a mop attachment module, according to some embodiments, whereby a rotational cylinder is positioned adjacent to a passage allowing liquid to flow from a reservoir.

FIGS. 3A and 3B illustrate a cross-sectional view of an embodiment wherein the rotatable cylinder is provided within the reservoir (rather than adjacent to it). FIG. 3A illustrates mop module 304 comprised of frame 302, liquid reservoir 301 containing liquid 303, rotatable cylinder 300 (which includes aperture 304 and axle 305), passage 306, and drainage mechanism 307. In this position, liquid 303 fills aperture 304 and rotatable cylinder 300 is blocking liquid from escaping reservoir 301.

As axle 305 turns, cylinder 300 will be rotated in direction 308 and aperture 304 will be rotated toward passage 306.

FIG. 3B illustrates a cross-sectional view of mop module 304 after cylinder 300 has been rotated in direction 308. In this position, cylinder 307 is rotated so that aperture 304 is adjacent to passage 306. In this position, liquid that had entered aperture 304 while it was previously adjacent to liquid 303 will flow downwards through passage 306 by means of gravity into drainage mechanism 307, to be dispersed onto the working surface through openings 309.

Liquid 303 is only delivered to drainage mechanism 307 when cylinder 300 is rotating. Since rotation of cylinder 300 is controlled by rotation of axle 305, liquid is no longer delivered to drainage mechanism 307 when axle 305 stops rotating.

Figure 4:
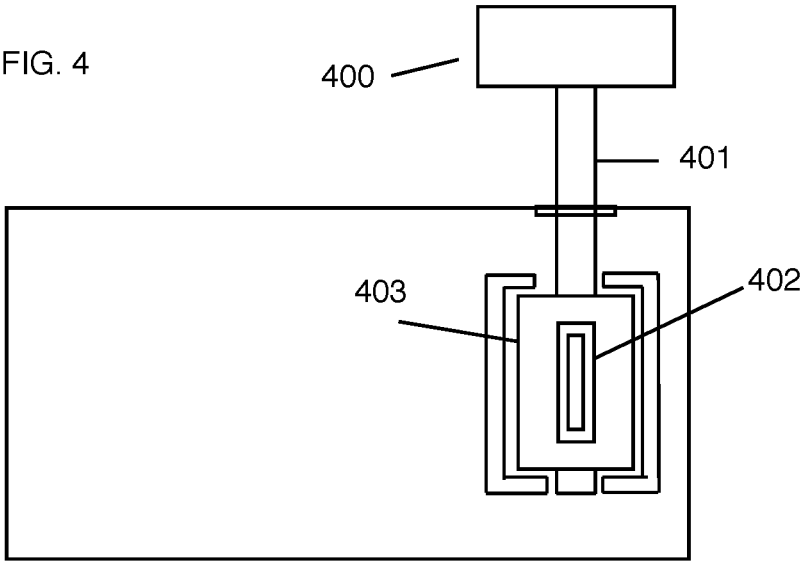
FIG. 4 illustrates a top view of a motor connected to a rotatable cylinder, according to some embodiments.

FIG. 4 illustrates a top view of motor 400 connected to rotatable cylinder 403 with aperture 402 by member 401. When the robotic floor cleaning device is operational, motor 400 operates thereby transferring rotational motion to rotatable cylinder 403 by connecting member 401.

It should be understood that in some embodiments, a frame to hold the mop module components may be omitted, and the components thereof may be built directly into the robotic floor cleaning device.

The size, number, and depth of apertures on the rotatable cylinder as well as the rotation speed of the rotatable cylinder may be modified to adjust the liquid flow rate from the reservoir.

In some embodiments, a removable mop module comprising the elements described above may be provided as an attachment to a robotic floor cleaning device. That is, the frame and all components may be removed and replaced as desired by an operator.

In some embodiments, the liquid flow rate from the reservoir may be adjusted by adding additional cylinders having at least one aperture and corresponding passages.

The invention claimed is:

1. A mop module of a robot, comprising:

a liquid reservoir for storing liquid; and an electronically-controlled liquid release mechanism;

wherein:

the electronically-controlled liquid release mechanism releases liquid from the liquid reservoir onto a work surface of the robot for mopping;

a schedule for mopping at least one area is determined by a processor of the robot or based on user input provided to an application of a communication device paired with the robot; and a quantity of liquid released while the robot mops the at least one area is determined by the processor of the robot or based on user input provided to the application of the communication device paired with the robot.

2. The mop module of claim 1, wherein the quantity of liquid released while the robot mops is controlled by at least an amount of power delivered to the electronically-controlled liquid release mechanism or a component thereof.

3. The mop module of claim 1, wherein the processor of the robot operates the electronically-controlled liquid release mechanism to release liquid onto the work surface upon a sensor disposed on the robot detecting dirt or a spill on the work surface.

4. The mop module of claim 1, wherein:

the processor of the robot determines when to operate the electronically-controlled liquid release mechanism to release liquid onto the work surface based on sensor data indicative of a floor type of the work surface of the robot;

operation of the electronically-controlled liquid release mechanism is ceased when the floor type is carpet; and the electronically-controlled liquid release mechanism is operational to release liquid onto the work surface when the floor type is a hard flooring.

5. The mop module of claim 1, wherein the schedule for mopping comprises a day, a time, at least one area, and a quantity of liquid to release while mopping the at least one area.

6. The mop module of claim 1, wherein the processor of the robot determines the schedule for mopping based on historical robot mopping habits of a user.

7. The mop module of claim 1, wherein the robot returns to a docking station during a cleaning cycle when the liquid reservoir is depleted of liquid and resumes the cleaning cycle from where the robot left off after the liquid reservoir is refilled.

8. The mop module of claim 1, wherein the liquid reservoir is removable from the robot.

9. The mop module of claim 1, wherein the robot mops an area when a user of the robot leaves the area and is no longer located within the area.

10. The mop module of claim 1, wherein the robot provides an alert for a user when the liquid reservoir needs to be refilled.

11. The mop module of claim 1, wherein the mop module further comprises:

a rotatable cylinder positioned within or adjacent to the liquid reservoir having at least one aperture for holding liquid collected from the liquid reservoir;

an axle connecting the rotatable cylinder to a motor transferring rotational movement from the motor to the cylinder;

a passage below the cylinder through which the liquid may pass; and a drainage mechanism positioned below the liquid reservoir and receiving the liquid from the passage for dispersing the liquid;

wherein:

rotation of the cylinder is caused by operation of the motor;

rotation of the axle causes the cylinder to rotate and at least one aperture to fill with the liquid from the liquid reservoir each time the at least one aperture is exposed to the liquid in the liquid reservoir; and the liquid exits the at least one aperture when the at least one aperture is adjacent to the passage and flows through the passage into the drainage mechanism from which the liquid is dispersed.

12. A robot for cleaning surfaces, comprising:

a processor;

a chassis;

a set of wheels coupled to the chassis;

a plurality of sensors; and a mop module, comprising:

a liquid reservoir for storing liquid; and an electronically-controlled liquid release mechanism;

wherein:

the electronically-controlled liquid release mechanism releases liquid from the liquid reservoir onto a work surface of the robot for mopping;

a schedule for mopping at least one area is determined by the processor of the robot or based on user input provided to an application of a communication device paired with the robot; and a quantity of liquid released while the robot mops the at least one area is determined by the processor of the robot or based on user input provided to the application of the communication device paired with the robot.

13. The robot of claim 12, wherein the processor of the robot operates the electronically-controlled liquid release mechanism to release liquid onto the work surface upon a sensor disposed on the robot detecting dirt or a spill on the work surface.

14. The robot of claim 12, wherein:

the processor of the robot determines when to operate the electronically-controlled liquid release mechanism to release liquid onto the work surface based on sensor data indicative of a floor type of the work surface of the robot;

operation of the electronically-controlled liquid release mechanism is ceased when the floor type is carpet; and the electronically-controlled liquid release mechanism is operational to release liquid onto the work surface when the floor type is a hard flooring.

15. The robot of claim 12, wherein the schedule for mopping comprises a day, a time, at least one area, and a quantity of liquid to release while mopping the at least one area.

16. The robot of claim 12, wherein the processor of the robot determines the schedule for mopping based on historical robot mopping habits of a user.

17. The robot of claim 12, wherein the robot returns to a docking station during a cleaning cycle when the liquid reservoir is depleted of liquid and resumes the cleaning cycle from where the robot left off after the liquid reservoir is refilled.

18. The robot of claim 12, wherein the liquid reservoir is removable from the robot.

19. The robot of claim 12, wherein the robot mops an area when a user of the robot leaves the area and is no longer located within the area.

20. The robot of claim 12, wherein the robot provides an alert for a user when the liquid reservoir needs to be refilled.

* * * * *